US006059531A

United States Patent [19]

Tai

[11] Patent Number: 6,059,531

[45] Date of Patent: May 9, 2000

[54] IMPELLER AND FAN BLADE ATTACHMENT ASSEMBLY

[76] Inventor: Jen-Lung David Tai, 19507 N. 65th Ave., Glendale, Ariz. 85308

[21] Appl. No.: 09/100,187

[22] Filed: Jun. 19, 1998

[51] Int. Cl.[7] ..... F04D 29/34

[52] U.S. Cl. ..... 416/220 A; 416/5; 416/221; 416/204 R; 416/205; 416/206; 416/207; 416/208; 416/210 R; 403/6; 403/9; 403/326; 403/327; 403/329

[58] Field of Search ..... 416/220 A, 5, 416/221, 204 R, 205, 206, 207, 208, 210 R; 403/326, 327, 329, 6, 9

[56] References Cited

U.S. PATENT DOCUMENTS 2,237,039 12/1941 Newnham ..... 416/214 R
5,421,701 6/1995 Funston ..... 415/5
5,462,412 10/1995 Scofield et al. ..... 416/210 R

*Primary Examiner*—Edward K. Look
*Assistant Examiner*—Rhonda Barton
*Attorney, Agent, or Firm*—Parsons & Goltry; Michael W. Goltry; Robert A. Parsons

[57] ABSTRACT

In a fan including a hub mounted for rotation and a plurality of fan blades, an attachment assembly for detachably engaging at least one of the plurality of fan blades with the hub, the attachment assembly comprising a stop carried adjacent an end of a selected one of the plurality of fan blades, a socket carried by the hub for receiving the end of the selected one of the plurality of fan blades, and an abutment mounted for movement between a first position to permit the end of the selected one of the plurality of fan blades to admit into the socket, and a normal second position against the stop.

20 Claims, 3 Drawing Sheets

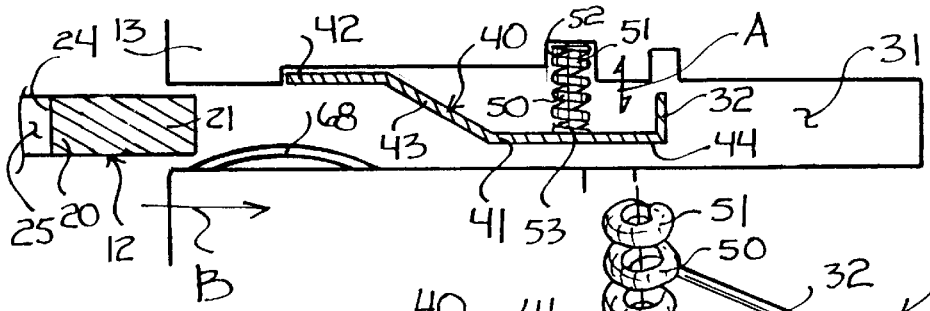
FIG. 4
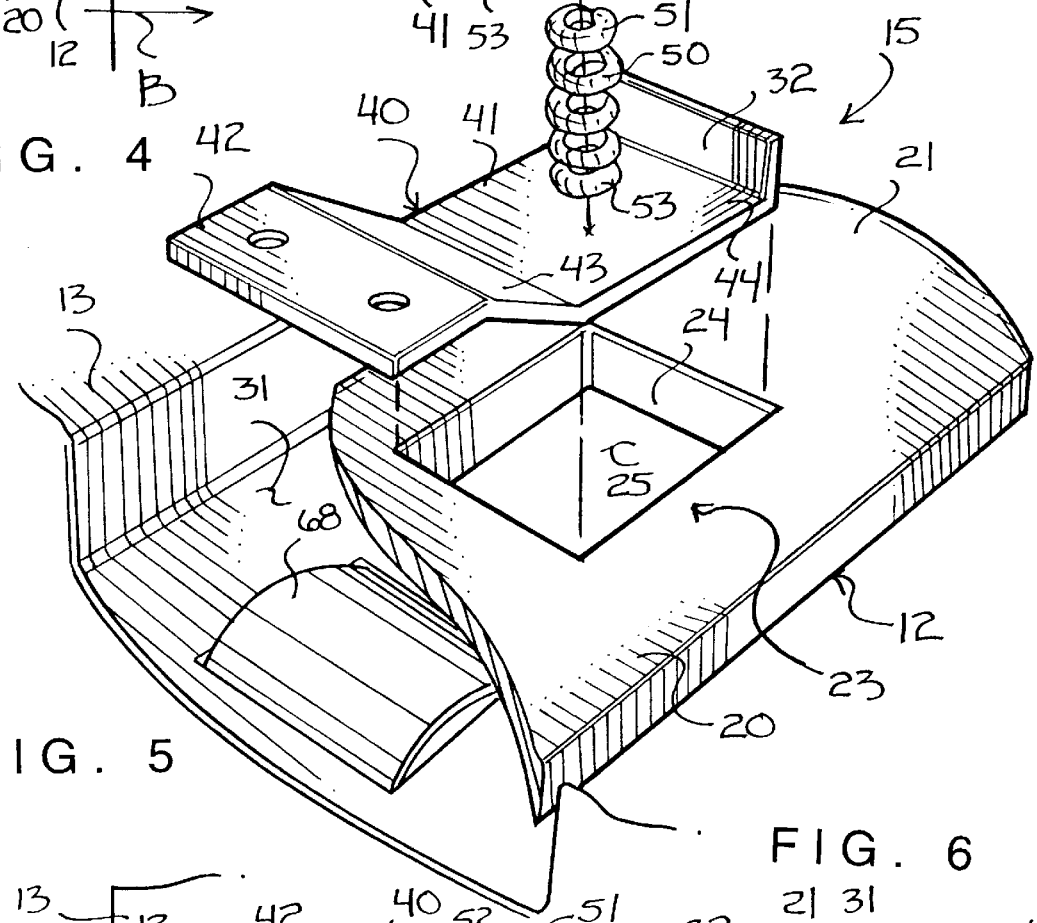
FIG. 5
FIG. 6
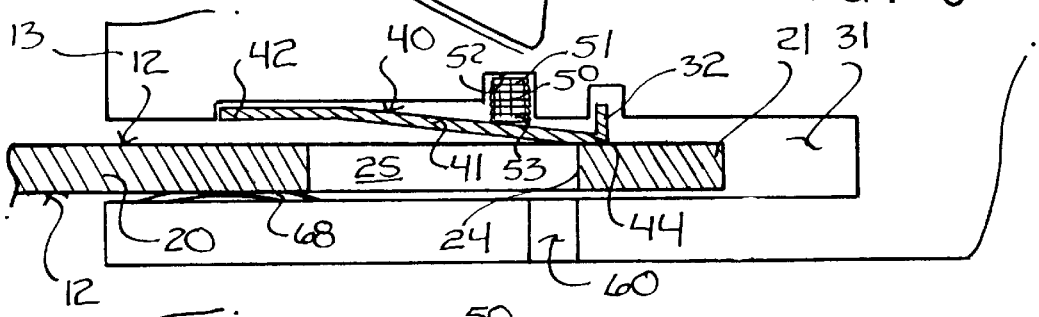
FIG. 7
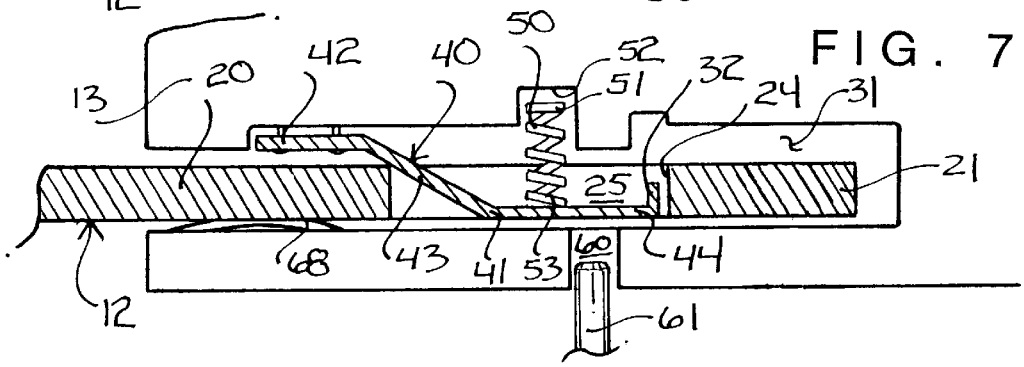

IMPELLER AND FAN BLADE ATTACHMENT ASSEMBLY

FIELD OF THE INVENTION

This invention relates generally to the field of fans and, more particularly, to impellers and to attachment assemblies for fan blades.

BACKGROUND OF THE INVENTION

The prior art is replete with fans of a type for producing a current of air or other gases or vapors. Fans are normally used for circulating air in rooms and buildings; for cooling motors and transmissions; for cooling and drying people, materials, or products; for exhausting dust and noxious fumes; for conveying light materials; for forced draft in steam boilers; and in heating, ventilating and air-conditioning systems.

A typical fan normally consists of a series of radial fan blades attached to a central rotating body or hub. The rotating assembly of blades and hub is known as an impeller, a rotor or a runner, and it may or may not be enclosed in a housing. Fans may be driven by an electric motor, an internal-combustion engine, a steam turbine, a gas turbine or other motive power.

Fan blades are normally fixed to the central rotating hub by means of conventional nut and bolt fastening mechanisms, welding or integral coupling. Although exemplary, known methods and mechanisms for attaching fan blades with a rotating hub fail to allow for the easy and efficient replacement of damaged or undesirable fan blades as needed.

It would be highly advantageous, therefore, to remedy the foregoing and other deficiencies inherent in the prior art.

It is a purpose of the present invention to provide a new and improved attachment assembly for detachably engaging fan blades with a rotating hub.

It is another purpose of the present invention to provide a new and improved attachment assembly that is easy to construct.

It is still another purpose of the present invention to provide a new and improved attachment assembly that is easy to use.

It is a further purpose of the present invention to provide a new and improved attachment assembly that is inexpensive.

It is yet a further purpose of the present invention is to provide a new and improved attachment assembly for detachably engaging a fan blade with a rotating hub that requires no specialized equipment.

It is still a further provision of the present invention to increase the ease and efficiency of fan blade replacement.

It is another provision of the present invention to alleviate the frustration that normally occurs when replacing fan blades.

It is yet another purpose of the present invention to provide a new and improved attachment assembly for detachably engaging fan blades with a rotating hub that is rugged and dependable.

It is still another purpose of the present invention to provide a new and improved attachment assembly for detachably engaging fan blades with a rotating hub of a ceiling fan.

SUMMARY OF THE INVENTION

The above problems and others are at least partially solved and the above purposes and others are realized in a new and improved impeller comprising a hub mounted for rotation, a plurality of fan blades, and a plurality of attachment assemblies each for detachably engaging one of the plurality of fan blades with the hub. Each one of the plurality of attachment assemblies comprises an engagement element carried by a selected one of the fan blades, and a detachably engagable complemental engagement assembly carried or otherwise supported by the hub.

In a specific embodiment, the engagement element includes a stop carried adjacent an end of the selected one of the plurality of fan blades. Furthermore, the complemental engagement assembly may include a socket carried by the hub for receiving the end of the selected one of the plurality of fan blades, and an abutment mounted for movement between a first position to permit the end of the selected one of the plurality of fan blades to admit into the socket, and a normal second position against the stop. In a specific embodiment, the abutment may be carried by an elongate element mounted for movement between the first and second normal positions of the abutment. It is normally preferred that the elongate element be biased, such as by a compression spring or by introducing a bias into the construction of the elongate element, for biasing the elongate element in the normal second position of the abutment.

To move the abutment from the normal second to the first position, the present invention may further include a way extending into the socket in substantial opposition to the elongate element, the way for receiving an implement therethrough for engaging and moving the elongate element from the normal second position to the first position of the abutment upon application of force to the implement.

BRIEF DESCRIPTION OF THE DRAWINGS

The foregoing and further and more specific objects and advantages of the instant invention will become readily apparent to those skilled in the art from the following detailed description thereof taken in conjunction with the drawings in which:

FIG. 4 is a vertical sectional view of an end of the fan blade of FIG. 2 showing an engagement element, and of portions of the rotating hub showing a detachably engagable complemental engagement assembly, in accordance with the present invention;

FIG. 5 is an exploded fragmented perspective view of the socket of the rotating hub, the end of the fan blade showing the engagement element, and the detachably engagable complemental engagement assembly of FIG. 4;

FIG. 6 is a view very similar to the view of FIG. 4, the end of the fan blade shown as it would appear partially received in a socket of the complemental engagement assembly;

FIG. 7 is a view very similar to the view of FIG. 6, the end of the fan blade shown as it would appear received in the socket of the complemental engagement assembly with an abutment of the complemental engagement assembly engaged against an endwall or stop comprising the engagement element.

DETAILED DESCRIPTION OF A PREFERRED EMBODIMENT

The present invention provides, among other things, a new and improved impeller including an attachment assembly for detachably engaging fan blades with a rotating hub. The present invention is useful with all types of conventional fan apparatus. However, the invention is particularly useful for use with convention ceiling fan apparatus for permitting the easy installation and replacement of ceiling fan blades.

Figure 1:
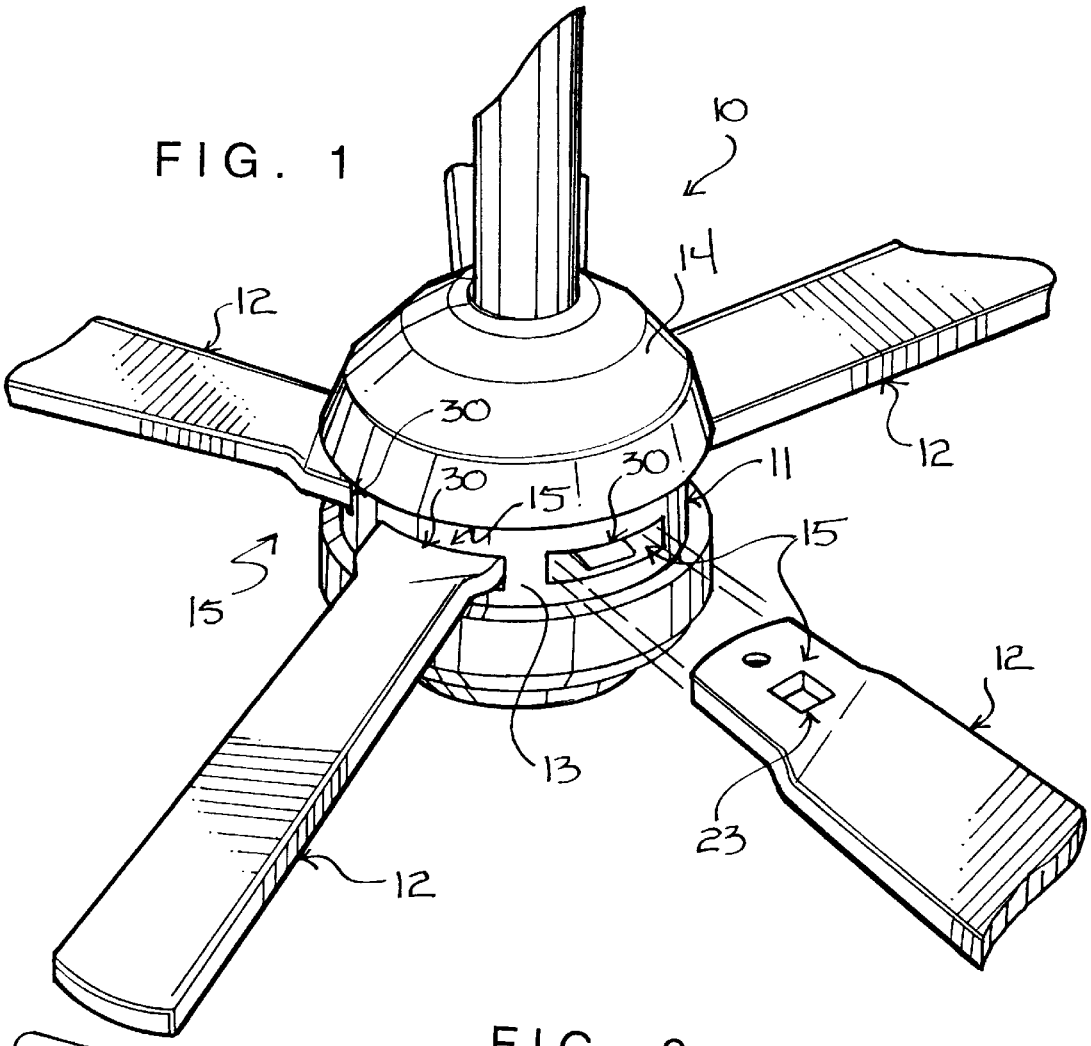
FIG. 1 is a perspective view of a fan including an impeller of the present invention including a plurality of fan blades carried by a rotating hub, one of the fan blades shown detached from the rotating hub.

Turning now to the drawings, in which like reference characters indicate corresponding elements throughout the several views, attention is first directed to FIG. 1 illustrating a perspective view of a fan 10 having an impeller 11 of the present invention including a plurality of fan blades 12 for displacing air and each engaged to hub 13 by an attachment assembly or mechanism generally designated at 15, one of the fan blades 12 shown as it would appear detached from hub 13. In this specific example, fan 10 is of a type commonly referred to as a ceiling fan with impeller 11 shown as it would appear partially carried in a decorative housing 14 and suspended for rotation from, for instance, a ceiling (not shown). In accordance with conventional practice, hub 13 may be rotated by a conventional electric motor or other suitable motive power.

Figure 3:
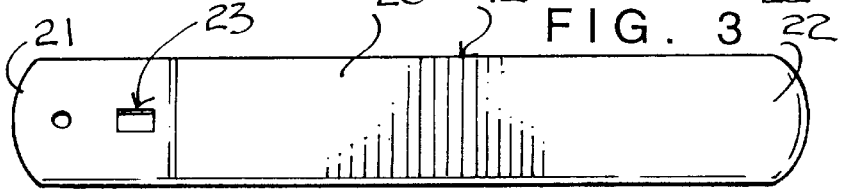
FIG. 3 is a top elevational view of the fan blade of FIG. 2.

With momentary attention directed to FIG. 3, each fan blade 12 is generally comprised of an elongate body 20 having a proximal end 21, a distal end 22 and an engagement element 23 of attachment mechanism 15 carried by elongate body 20 adjacent proximal end 21. With momentary reference directed to FIG. 5, engagement element 23 includes an endwall or stop 24 directed toward proximal end 21 of which, in this specific example, forms part of an opening 25 extending into and through elongate body 20 adjacent proximal end 21.

With attention directed back to FIG. 1, carried or otherwise supported by hub 13 at spaced radial intervals are a plurality of complemental engagement assemblies 30 of each attachment mechanism 15. Referring to FIG. 4 illustrating a vertical sectional view of one of the plurality of complemental engagement assemblies 30, each complemental engagement assembly includes a socket 31 extending into hub 13 for receiving proximal end 21 of a selected one of fan blades 12, and an abutment 32 mounted in socket 31 for movement in reciprocal directions as generally indicated by the double arrowed line A between a first position away from socket 31 to permit proximal end 21 of a selected one of fan blades 12 to admit into socket 31, and a normal second position into socket 31 for receipt against endwall 24.

With continuing reference to FIG. 4 and additional reference to FIG. 5, abutment 32 is carried by an elongate element 40. Elongate element 40, of which is preferably constructed of a flexible plastic or metallic material, includes a body 41 having a proximal end 42 fixed to hub 13 such as by screws, a selected adhesive, rivets or other selected mechanical fastening mechanism. Body 41 extends into socket 31 from proximal end 42 along an angled portion 43 thereof terminating with a distal end 44 that carries abutment 32, body 41 being movable between the first and second normal positions of abutment 32.

In accordance with a preferred embodiment, it is desirable to bias elongate element 40 in the normal second position of abutment 32. To this end, and with attention directed to FIG. 4, complemental engagement assembly 30 may further include, for example, a compression spring 50 having an end 51 captured against hub 13 in a recess 52 formed therein, and another end 53 directed against body 41 generally intermediate the proximal and distal ends 42 and 43 of body 41, respectively. In lieu of, for instance, compression spring 50, body 41 may be constructed of a selected metal or plastic having shape memory for normally biasing body 41 in the normal second position of abutment if so desired.

Figure 2:
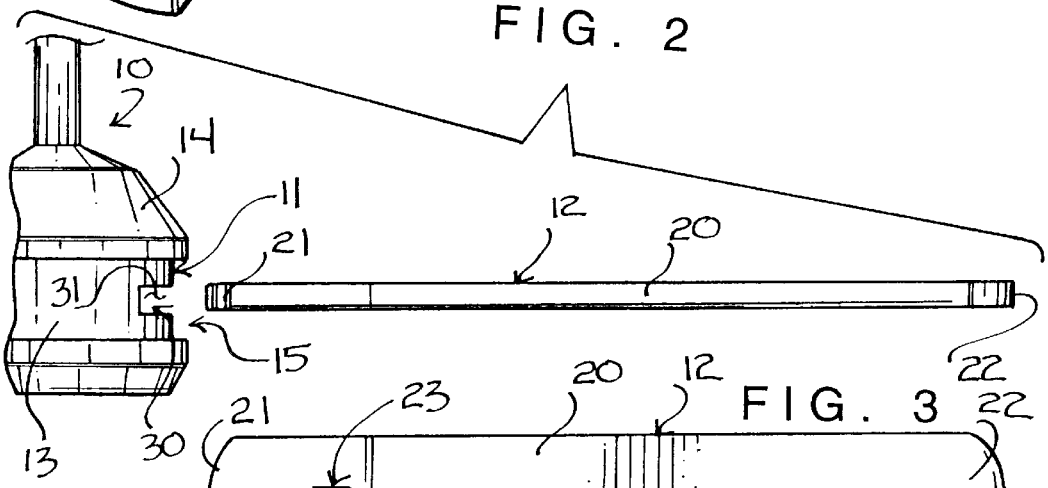
FIG. 2 is a fragmented side elevational view of the fan of FIG. 2 showing a fan blade as it would appear detached from the rotating hub.

In operation, a selected one of fan blades 12 may be grasp, such as by one or more human hands, and proximal end 21 directed toward one of sockets 31 as shown substantially in FIG. 2. Proximal end 21 may then be moved or otherwise introduced into and through socket 31 in the direction generally indicated by the arrowed line B in FIG. 4. As proximal end 21 is urged into socket 31, proximal end 21 will abut against angled portion 43 forcing body 41 to flex to overcome the bias of compression spring 50 and to move abutment 32 from the normal second position as shown in FIG. 4 to the first position away from socket 31 as shown substantially in FIG. 6. As proximal end 21 is so urged into socket 31, body 41 will run along elongate body 20 of fan blade of the selected fan blade 12 until distal end 44 of elongate element and abutment 32 clear endwall 24, at which point body 41 will snap receive into opening 25 in the normal second position of abutment 32. In the normal second position of abutment 32, endwall 24 will substantially oppose and engage against abutment 32 inhibiting fan blade 12 from releasing outwardly from socket and providing for the detachable engagement of fan blade 12 with socket 31.

To release fan blade 12 from socket 31, the foregoing operation need only be reversed. In this regard, and with regard to FIG. 7, hub 13 may be provided with a channel or way 60 extending inwardly therethrough into socket 31 in substantial opposition to elongate element 40 and opening 25 of fan blade 12. To move abutment 32 from the normal second position into the first position, an implement 61, such as a pencil, screwdriver, etc., may be inserted into and through way 60 to engage and, through the application of force applied to implement 61, overcome the bias of compression spring 50 to move elongate element 40 from the normal second position of abutment to the first position of abutment away from socket 31 and endwall 24. Fan blade 12 may then be moved outwardly from socket 31 to permit distal end 44 of elongate element 40 to rest against fan blade outboard of opening 25 toward proximal end 21. Implement 61 may then be removed from way 60 and fan blade 12 pulled away and out of socket 31.

In summary, the present invention provides an exemplary attachment mechanism for detachably engaging fan blades with a rotating hub of, for instance, a ceiling fan. Consistent with the nature and scope of the present invention, the attachment mechanism of the present invention may be incorporated into a variety of fan apparatus of the type including, among other things, an impeller having a rotating hub and replaceable fan blades.

Figure 8:
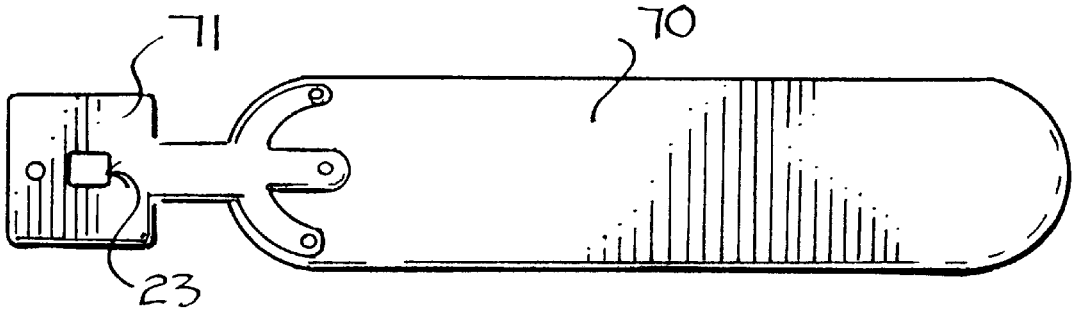
FIG. 8 is a top elevational view of another embodiment of a fan blade.

The present invention has been described above with reference to a preferred embodiment. However, those skilled in the art will recognize that changes and modifications may be made in the described embodiments without departing from the nature and scope of the present invention. For instance, and with attention directed to FIGS. 4–7, hub 13 may be provided with a spring 68 directed into or otherwise toward socket 31 in substantial opposition to proximal end 42 of elongate element 40. Spring 68, of which may be constructed of a springy metal or other similar material having shape memory with a bias directed normally outwardly toward socket 31, may be used if desired for bearing against fan blade 12 for further securing or otherwise capturing fan blade 12 in place in socket 31 as shown substantially in FIGS. 6 and 7. Furthermore, and with attention directed to FIG. 8, fan blades of the type used in combination with ceiling fans may include a blade element 70 fixed, such as by conventional threaded fasteners, rivets, etc., to a blade holder 71. In this regard, blade holder 71 may be provided with engagement element 23 if so desired and installed with socket 31 of hub 13 in the same manner as the selected one of fan blades 12 herein previously discussed. In this regard, it is generally intended that a fan blade having a blade holder be included within the general structural definition of fan blade 12 as herein generally discussed, wherein the blade holder would merely represent an extension thereof.

Consistent with the nature and scope of the present invention, it may be desirable to provide one or more conventional blade holders with a complemental engagement assembly 30. In this regard, a conventional blade holder, such as blade holder 71, may be fixed to a rotating hub of, for instance, a conventional ceiling fan such as with screws, rivets or other suitable fastening mechanism. The blade holder may thus be provided with a complemental engagement assembly 30 at, for instance, a free or distal end thereof, the complemental engagement assembly 30 being available for admitting and detachably engaging an engagement element 23 of, for instance, one of fan blades 12. For clarity and understanding in light of the ensuing claims, it is generally intended that a rotating hub is considered to support or otherwise carry one or more complemental engagement assemblies 30 carried by one or more blade holders fixed or otherwise coupled or carried by the rotating hub, wherein the one or more blade holders would merely represent an extension of the rotating hub.

Various changes and modifications to the embodiment herein chosen for purposes of illustration will readily occur to those skilled in the art. To the extent that such modifications and variations do not depart from the spirit of the invention, they are intended to be included within the scope thereof which is assessed only by a fair interpretation of the following claims.

Having fully described the invention in such clear and concise terms as to enable those skilled in the art to understand and practice the same, the invention claimed is:

What is claimed is:

1. An impeller, comprising:

a hub mounted for rotation;

a plurality of fan blades; and a plurality of attachment assemblies each for detachably engaging one of the plurality of fan blades with the hub, wherein each of the plurality of attachment assemblies comprises:

a stop carried adjacent an end of one of the plurality of fan blades;

a socket carried by the hub for receiving the end;

an abutment mounted for movement between a first position to permit the end to admit into the socket and a second position against the stop; and means for biasing the abutment in the second position.

2. The impeller of claim 1, wherein the means for biasing the abutment is captured between the socket and the abutment.

3. The impeller of claim 2, wherein the means for biasing the abutment comprises a compression spring having an end directed toward the socket and another end directed toward the abutment.

4. The impeller of claim 1, wherein an elongate element supports the abutment for movement between the first and second positions.

5. The impeller of claim 4, wherein the means for biasing the abutment is captured between the socket and the elongate element.

6. The impeller of claim 5, wherein the means for biasing the abutment comprises a compression spring having an end directed toward the socket and another end directed toward the elongate element.

7. The impeller of claim 4, further including a way extending into the socket in substantial opposition to the elongate element, the way for receiving an implement therethrough for engaging and moving the elongate element from the second position to the first position of the abutment upon application of a force to the implement.

8. The impeller of claim 1, further including a spring directed toward the socket for bearing against and capturing the one of the plurality of fan blades with the socket.

9. An impeller, comprising:

a hub mounted for rotation;

a plurality of fan blades; and a plurality of attachment assemblies each for detachably engaging one of the plurality of fan blades with the hub, wherein each of the plurality of attachment assemblies comprises:

a stop carried adjacent an end of one of the plurality of fan blades;

a socket carried by the hub for receiving the end;

an elongate element mounted to the hub that supports an abutment for movement between a first position to permit the end to admit into the socket and a second position against the stop; and means for biasing the elongate element in the second position of the abutment.

10. The impeller of claim 9, wherein the means for biasing the elongate element includes a compression spring captured between the socket and the elongate element.

11. The impeller of claim 9, further including a way extending into the socket in substantial opposition to the elongate element, the way for receiving an implement therethrough for engaging and moving the elongate element from the second position to the first position of the abutment upon application of a force to the implement.

12. The impeller of claim 9, further including a spring directed toward the socket for bearing against and capturing the one of the plurality of fan blades with the socket.

13. In a fan including a hub mounted for rotation and a plurality of fan blades, an attachment assembly for detachably engaging at least one of the plurality of fan blades with the hub, the attachment assembly comprising:

a stop carried adjacent an end of one of the plurality of fan blades;

a socket carried by the hub for receiving the end;

an abutment mounted to the hub for movement between a first position to permit the end to admit into the socket and a second position against the stop; and means for biasing the abutment in the second position.

14. The attachment assembly of claim 13, wherein the means for biasing the abutment is captured between the socket and the abutment.

15. The attachment assembly of claim 14, wherein the means for biasing the abutment comprises a compression spring having an end directed toward the socket and another end directed toward the abutment.

16. The attachment assembly of claim 13, wherein an elongate element supports the abutment for movement between the first and second positions.

17. The attachment assembly of claim 16, wherein the means for biasing the abutment is captured between the socket and the elongate element.

18. The attachment assembly of claim 17, wherein the means for biasing the abutment comprises a compression spring having an end directed toward the socket and another end directed toward the elongate element.

19. The attachment assembly of claim 16, further including a way extending into the socket in substantial opposition to the elongate element, the way for receiving an implement therethrough for engaging and moving the elongate element from the second position to the first position of the abutment upon application of a force to the implement.

20. The attachment assembly of claim 13, further including a spring directed toward the socket for bearing against and capturing the one of the plurality of fan blades with the socket.

* * * * *